US009494397B2

(12) United States Patent
Carlson et al.

(10) Patent No.: US 9,494,397 B2
(45) Date of Patent: Nov. 15, 2016

(54) POLYMER PROJECTILE HAVING AN INTEGRATED DRIVING BAND

(71) Applicant: Vista Outdoor Operations LLC, Clearfield, UT (US)

(72) Inventors: Erik K. Carlson, Oak Grove, MN (US); Joshua L. Edel, East Bethel, MN (US); Lawrence P. Head, Cambridge, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 14/362,089

(22) PCT Filed: Nov. 30, 2012

(86) PCT No.: PCT/US2012/067482
§ 371 (c)(1),
(2) Date: May 30, 2014

(87) PCT Pub. No.: WO2013/082557
PCT Pub. Date: Jun. 6, 2013

(65) Prior Publication Data

US 2014/0318402 A1 Oct. 30, 2014

Related U.S. Application Data

(60) Provisional application No. 61/565,340, filed on Nov. 30, 2011, provisional application No. 61/587,101, filed on Jan. 16, 2012, provisional application No. 61/654,560, filed on Jun. 1, 2012.

(51) Int. Cl.

| | |
|---|---|
| ***F42B 12/40*** | (2006.01) |
| ***F42B 5/145*** | (2006.01) |
| ***F42B 14/02*** | (2006.01) |
| ***F42B 30/02*** | (2006.01) |
| ***F42B 33/00*** | (2006.01) |
| ***F42B 12/76*** | (2006.01) |

(52) U.S. Cl.
CPC ..... *F42B 33/00* (2013.01); *F42B 5/145* (2013.01); *F42B 12/40* (2013.01); *F42B 12/76* (2013.01); *F42B 14/02* (2013.01); *F42B 30/02* (2013.01)

(58) Field of Classification Search
CPC ..... F42B 5/145; F42B 12/40; F42B 12/76; F42B 14/02; F42B 33/00; F42B 12/36; F42B 30/02
USPC ..... 102/439, 513, 524, 526, 501, 502; 86/54
See application file for complete search history.

(56) References Cited

U.S. PATENT DOCUMENTS 4,128,059 A * 12/1978 Black ..... 102/513
H114 H * 8/1986 Quintavalle ..... 102/513
4,884,508 A * 12/1989 Kruse et al. ..... 102/524
(Continued)

*Primary Examiner* — James S Bergin
(74) *Attorney, Agent, or Firm* — Christensen Fonder P.A.

(57) ABSTRACT

A lightweight projectile having an integrated driving band positioned around the exterior of the polymer base of the projectile for engaging the rifling of a barrel to impart spin stabilization to the projectile. The driving band protrudes from the polymer base to minimize the contact between the polymer base and the rifling to reduce friction between the barrel and the projectile as the projectile is fired. The reduced friction allows the lightweight projectile to be propelled with minimal propellant force while still retaining the ballistic advantages of a spin stabilized projectile.

12 Claims, 19 Drawing Sheets

(56) References Cited

U.S. PATENT DOCUMENTS

| | | | | |
|---|---|---|---|---|
| 4,958,570 | A | 9/1990 | Harris | |
| 5,388,524 | A * | 2/1995 | Strandli et al. | 102/529 |
| 7,207,276 | B1 * | 4/2007 | Dindl | F42B 5/02 102/443 |
| 7,278,358 | B2 * | 10/2007 | Huffman | 102/502 |
| 7,331,293 | B2 * | 2/2008 | Saxby | F42B 12/40 102/502 |
| 8,065,962 | B2 * | 11/2011 | Haeselich | 102/513 |
| 8,327,767 | B2 * | 12/2012 | Lafortune | F42B 8/02 102/439 |
| 2005/0183612 | A1 | 8/2005 | Huffman | |
| 2006/0027128 | A1 | 2/2006 | Hober | |
| 2011/0067593 | A1 | 3/2011 | Klein | |
| 2014/0373745 | A1 * | 12/2014 | Carlson et al. | 102/502 |

* cited by examiner

POLYMER PROJECTILE HAVING AN INTEGRATED DRIVING BAND

RELATED APPLICATIONS

The present application is a National Phase entry of PCT Application No. PCT/US2012/067482, filed Nov. 30, 2012, which claims the benefit of U.S. Provisional Application No. 61/565,340 entitled POLYMER PROJECTILE HAVING AN INTEGRATED DRIVING BAND, filed Nov. 30, 2011, U.S. Provisional Application No. 61/587,101 entitled POLYMER PROJECTILE HAVING AN INTEGRATED DRIVING BAND, filed Jan. 16, 2012, and U.S. Provisional Application No. 61/654,560 entitled POLYMER PROJECTILE HAVING AN INTEGRATED DRIVING BAND, filed Jun. 1, 2012, which are incorporated herein in their entirety by reference.

FIELD OF THE INVENTION

The present invention is generally directed to a lightweight polymer projectile for use with rifled barrels to impart spin stabilization to the projectile. Specifically, the present invention is directed to a projectile having a polymer base with an integrated driving band for engaging the rifled barrels to impart spin stabilization to the projectile with minimal friction between the projectile and the barrel.

BACKGROUND OF THE INVENTION

The use of lightweight non-lethal projectiles in place of conventional bullets has recently increased. Projectiles made of lightweight polymers are used by the military and law enforcement in conventional or specialized training firearms for training and non-lethal applications. Similarly, spherical polymer projectiles are also often used in air guns and other pneumatic guns for recreational use. These projectiles often comprise low-weight and/or frangible materials such as lightweight polymers that transfer less energy to the target than conventional bullets causing significantly less or no damage to the target. The lower weight of the polymer materials as compared to heavier conventional bullets or metal pellets allows the projectiles to be fired with a reduced propellant charge or by a lower pressure compressed air and travel at a lower speed to further reduce the likelihood of damage to the target.

The drawback of using conventional lightweight polymer projectiles is that the lower relative weight used to reduce the momentum of the projectile and consequently the damage caused by the projectile impact also inherently worsens the ballistic characteristics of the projectile. Specifically, the lower weight reduces the effective range in which the projectile can be fired with reasonable accuracy. A common approach to improving the effective range of the lightweight projectile is to increase the muzzle velocity of the projectile by increasing the propellant charge or providing additional compressed air or gas. This increased muzzle velocity compensates for the reduced weight to increase the effective range of the projectile increases. However, the increased muzzle velocity creates a standoff distance within which the projectile is travelling sufficiently fast to possibly cause excessive or lethal damage to any impacted target. As a result, compensating for the reduced weight of the projectile by increasing the muzzle velocity of the projectile also increases the standoff distance.

The rifled barrel found in many conventional firearms is also used to improve the effective range of conventional bullets by imparting a spin to the bullet as it travels through the barrel. The spin stabilized bullet has a greater effective range at which the bullet can be fired accurately than a bullet that is simply fired through an unrifled barrel. Although the contact between the bullet and the rifling inside the barrel etches striations into the exterior of the bullet, the bullet will travel through the barrel with minimal friction after the initial engraving of the metal exterior or jacket. Moreover, the heavier weight and faster velocity of conventional bullets minimizes the effect of the friction caused by the contact between the bullet and the rifling.

In contrast, the significantly reduced energy of the lightweight projectile caused by the reduced weight and velocity of the projectile maximizes the effect of the friction between the projectile and rifling. In addition, the friction caused by the contact between the metal rifling and lightweight polymer projectiles is often significantly greater than the metal-metal contact between the rifling and a conventional bullet. Moreover, the spherical pellets used in most air or pneumatic guns do not have the requisite surface area contacting the rifling to receive the necessary spin from the rifling. However, the spherical pellets are favored in air guns as easier to load and handle within the air gun.

Another drawback is that the increased friction coupled with the low weight of the projectile increases the effect of barrel length on the ballistic characteristics of the projectile. A longer barrel length can result in a slower muzzle velocity than a projectile fired through a shorter barrel potentially resulting in significantly different ballistic characteristics from barrel to barrel. Similarly, the metal rifling can strip away shavings from the softer polymer projectiles fouling the barrel. As a result, firearms used to fire lightweight polymer projectiles can require substantially more maintenance than firearms only firing conventional bullets and can create a potential safety risk if the fouling blocks barrel. Similarly, metal or composite pellets are typically used in air guns having rifled barrels as the plastic pellets will become caught within the barrel or be significantly damaged travelling through the barrel.

Known prior art practice ammunition, particularly 5.56 mm marking practice ammunition, designed for the AR-15 style rifles, have expanding telescoping cartridges and utilize a primer for propulsion or a primer in combination with a secondary propellent. The known commercial embodiments as tested provide kinetic energy levels above 62 either provide sufficient kinetic energy to cause damage to the environment, such as dings in walls, or have excessive weight and low velocity such that range and accuracy are diminished. No known prior art 5.56

Lightweight projectiles have significant advantages when used for non-lethal or training purposes. However, the inherent tradeoff between improved ballistic characteristics from increased muzzle velocities and increased standoff distance limit the usefulness of the projectiles. Similarly, the improved ballistic characteristics provided by the rifling of the barrel must be weighed against the inconsistent performance from barrel to barrel and the potential risk of fouling.

SUMMARY OF THE INVENTION

An embodiment of the present invention is directed to a lightweight projectile comprising a polymer projectile base having at least one integrated driving band in which a projecting portion of the band protrudes from the exterior of the polymer base to engage the rifling of a rifled barrel. The lightweight projectile can comprise a low weight polymer, compressed pulp or ceramic material such that the projectile has a lower weight than equivalent conventional projectiles to lessen the potential damage that can be caused by the projectile upon impact. For pneumatic or air gun projectiles the weight of the projectile can approximate the weight of conventional BBs or non-lethal pellets. Each driving band can engage the inside of the barrel including the rifling of the barrel in the same manner as conventional metal bullets to impart spin to the projectile.

In one aspect, the projecting portion comprises a thin cantilevered ring perpendicular to the axis of the polymer base and that extends radially outward from the polymer base to prevent the rifling from directly engaging the polymer base. The projecting portion comprises a metal such as copper, gold, brass, aluminum, rigid polymer, or composite material that can engage the rifling with less friction that the lightweight polymer used in the projectile base. The reduced friction between the projectile and the barrel interior eliminates the need to compensate for the friction by increasing the weight or velocity of the projectile. In one aspect, the rifling can cut grooves in the projecting portion in the same way as a conventional bullet is etched by the rifling. In another aspect, the projecting portion can be folded over by the rifling to form a surface generally parallel to the axis of the polymer base to engage the rifling as the projectile travels down the barrel. The driving band further comprises an embedded portion extending into the polymer base to support the projecting portion of the driving band.

In an embodiment, the driving band has an embedded portion and a projecting portion, the projecting portion forming a thin, in the axial direction, cantilevered ring that extends radially outward from the polymer base. In one aspect, the embedded portion and the projecting portion can provide a weight positioned radially around the exterior of the projectile base allowing the projectile to spin more efficiently while in flight. In this configuration, the size of the embedded portion can be increased or decreased to change relative weight distribution of the projectile and accordingly its spin characteristics.

A non-lethal projectile, according to an embodiment of the present invention, generally comprises a polymer projectile base and at least one driving band positioned around the periphery of the projectile base. The projectile base can comprise an elongated cylindrical shape made of a lightweight polymer material. In one aspect, the projectile can further comprise a frangible cap having an engagement portion for affixing the frangible cap to the projectile base. In this configuration, the projectile base can further comprise a base portion and a cup portion for receiving the engagement portion of the frangible cap. In one aspect, the projectile base can define an inset in the base portion that is aligned with the propellant source for efficiently capturing the propellant gases generated by a pneumatic source or an ignited propellant or primer. Each driving band extends around the exterior of the projectile base and protrudes radially outwardly from the projectile base to engage the rifling of the barrel as the projectile is fired. According to an embodiment, the driving band extends around the base portion of the projectile base. The driving band comprises a lightweight, rigid material that can engage the rifling to impart spin to the projectile with less friction that direct engagement of the polymer projectile base with the rifling.

In one aspect, the driving band remains with the projectile after the projectile leaves the muzzle, wherein the light weight of the driving band minimally increases the momentum of the projectile minimizing risk of injury or damage. In another aspect, the driving band can unfurl from the projectile like a sabot as the projectile leaves the muzzle of the rifled barrel such that the projectile base travels to the target without the additional weight of the driving band.

In an embodiment of the present invention, the driving band can comprise an embedded portion and a projecting portion, the projecting portion forming a thin, in the axial direction, circumferentially extending metal member that extends radially outward from the polymer base. The projecting portion can be configured to deform, that is, to flex upon engaging the rifling of the projectile. Alternatively, the projecting portion can comprise a rigid material that can be etched or permanently deformed by the rifling as the projectile travels down the barrel in a similar fashion to conventional bullets. In one aspect, the projecting portion is ring shaped, other embodiments, the projecting portion can be helical or have helical portions.

In an embodiment, a 5.56 mm practice cartridge has an expanding casing for operating ejection mechanisms, and has a projectile comprising a polymer base, with marking media in a sealed interior, and a metallic driving band embedded in and extending from the base. The projectile weighing less than 4.25 grains in embodiments. encircling the m In an embodiment of the present invention, the projectile can comprise multiple driving bands sized protruding from the projectile base. In this configuration, the driving bands can be positioned axially along the projectile base such that no portion of the projectile base can engage the rifling of the barrel directly. In another aspect, a driving band can be positioned on the frangible cap that can cooperate with the driving band positioned on the projectile base to prevent engagement of either frangible cap or the projectile base by the rifling of the barrel.

A method of making a non-lethal projectile with at least one driving band, according to an embodiment of the present invention, can comprise separately stamping or forming the driving band and the polymer base. The driving band can then be fitted over the polymer base to affix the driving band to the polymer base. Alternatively, the driving band can be placed in a mold and the projectile base or the base portion of the projectile base can be molded over the driving band. According to another embodiment, a polymer driving band can be over-molded onto a pre-molded polymer base. Powdered metal can be sintered or depositing or otherwise layering onto a driving band on a polymer base. In embodiments the driving band can comprise a thin metallic layer, such as a deposited layer or a foil disposed over a protruding polymer rib, the rib unitary with the projectile base such that the surface engagement with the barrel is the thin metallic layer but the polymer rib provides the structural support for the layer. In such a case the polymer rib can be deformed by the barrel rifling while sustaining the barrel metal to metal layer engagement.

In embodiments of the invention, the driving band is foldable or engravable when engaging with the rifling of barrel through which it is fired.

In embodiments of the invention, a polymer rib provides a backing of the driving band and is crushable or deformable when engaging with the rifling of barrel through which it is fired. In such embodiments, a portion of the driving band may be a foil or thin layer on the polymer rib.

In embodiments of the invention, the material of the driving band does not shed and does not adhere to the steel of the barrel through which it is fired.

In an embodiment, the driving band comprises a material selected from a group consisting of gilding metals, rigid polymers and metal impregnated polymers, and wherein the driving band has a coefficient of friction less than the coefficient of friction of the frangible polymer cap.

A feature and advantage of embodiments of the invention is that greater accuracy at greater distances with less kinetic energy than the prior art is provided. With less energy, the ammunition is safer, and has less potential for damaging property than the prior art.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
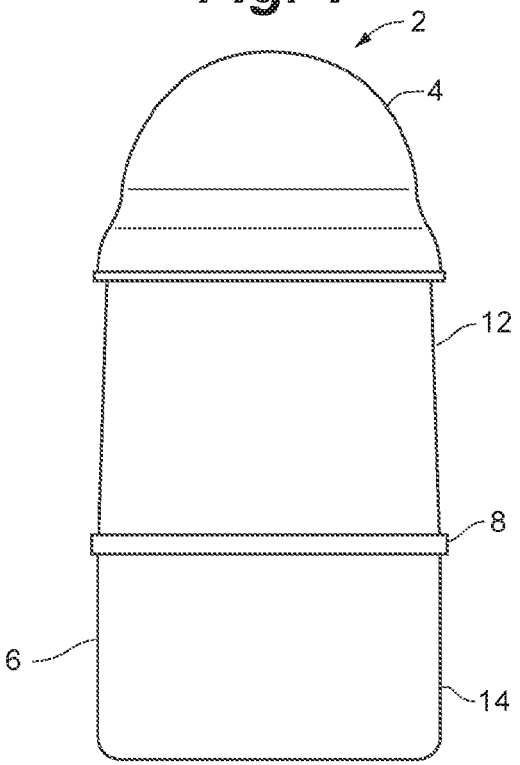
FIG. 1 is a side view of a non-lethal projectile having a driving band according to an embodiment of the present invention.
Figure 2:
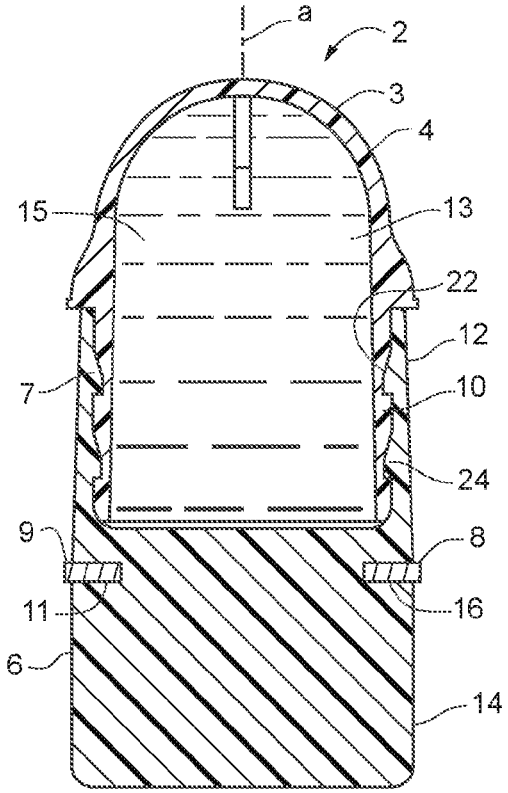
FIG. 2 is a cross-sectional side view of the non-lethal projectile depicted in FIG. 1.
Figure 3:
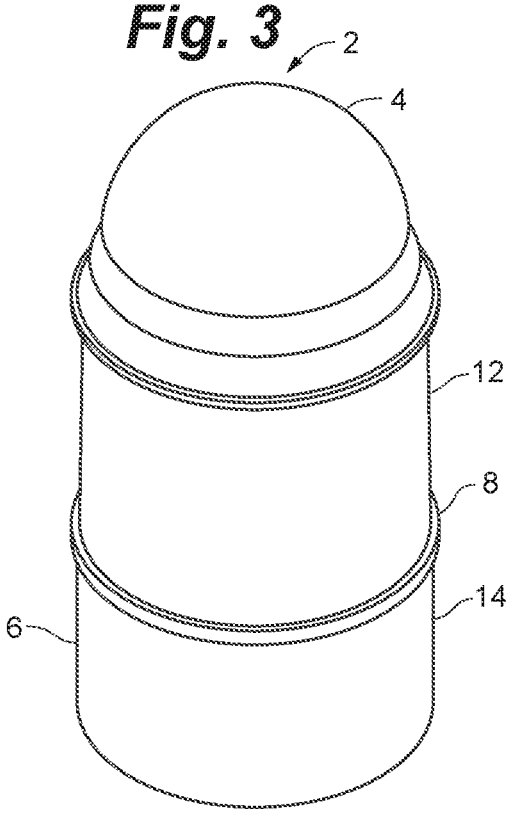
FIG. 3 is a perspective view of the non-lethal projectile depicted in FIG. 1.
Figure 4:
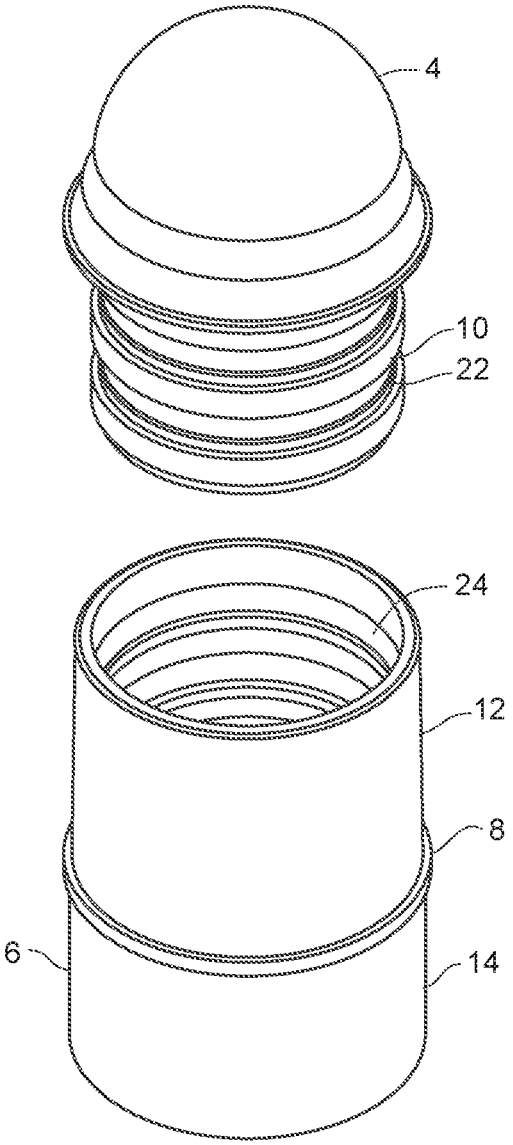
FIG. 4 is an exploded view of the non-lethal projectile depicted in FIG. 1.
Figure 5:
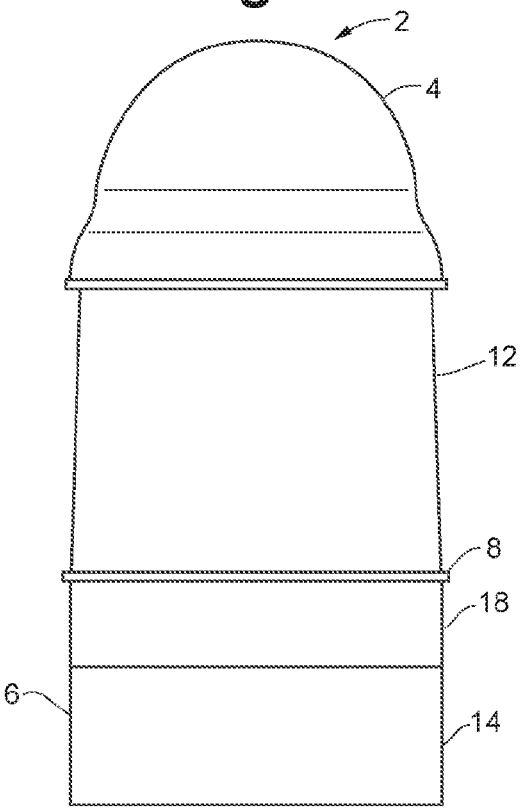
FIG. 5 is a side view of a non-lethal projectile having a driving band according to an embodiment of the present invention.
Figure 6:
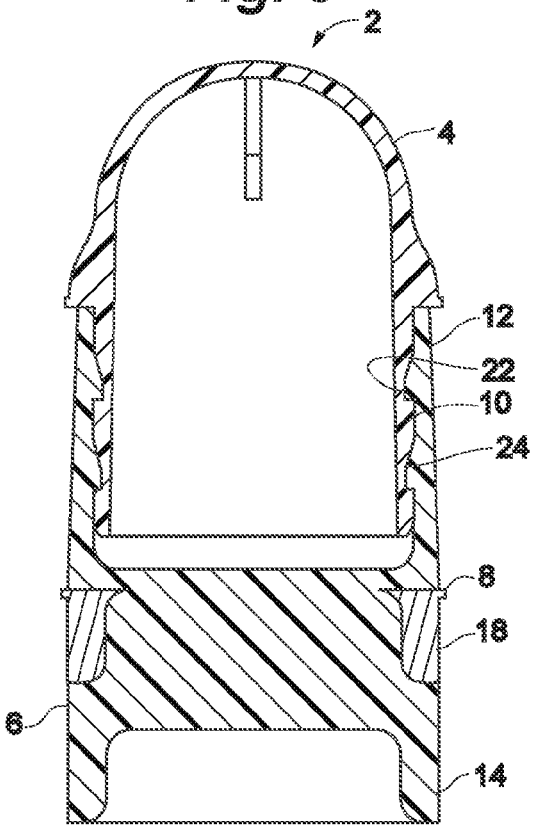
FIG. 6 is a cross-sectional side view of the non-lethal projectile depicted in FIG. 5.
Figure 7:
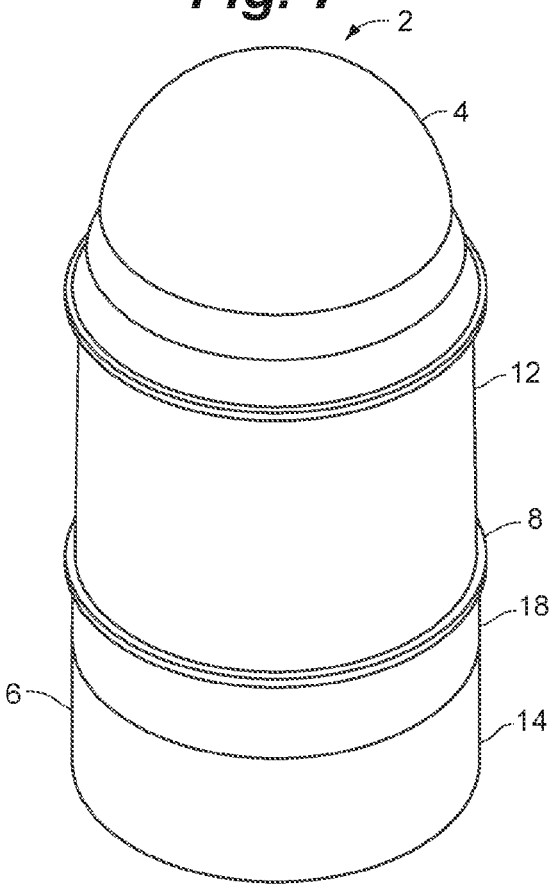
FIG. 7 is a perspective view of the non-lethal projectile depicted in FIG. 5.
Figure 8:
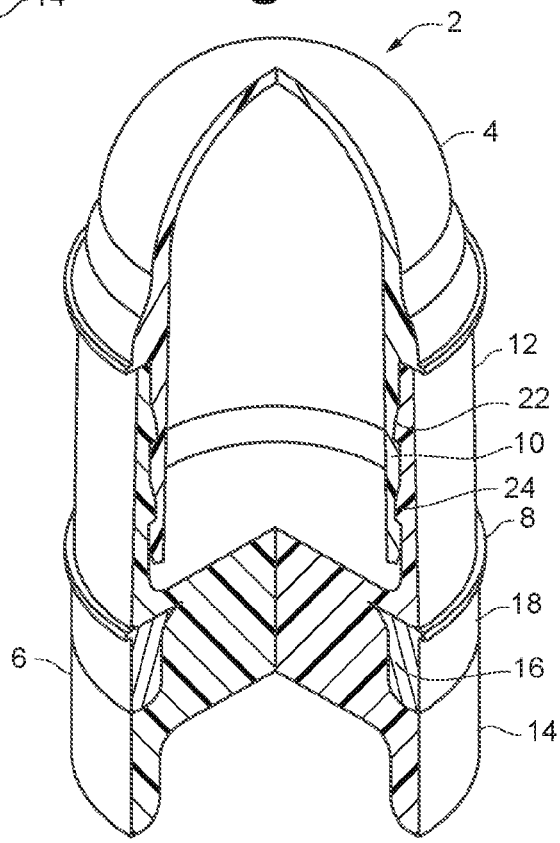
FIG. 8 is a cross-sectional perspective view of the non-lethal projectile depicted in FIG. 5.
Figure 9:
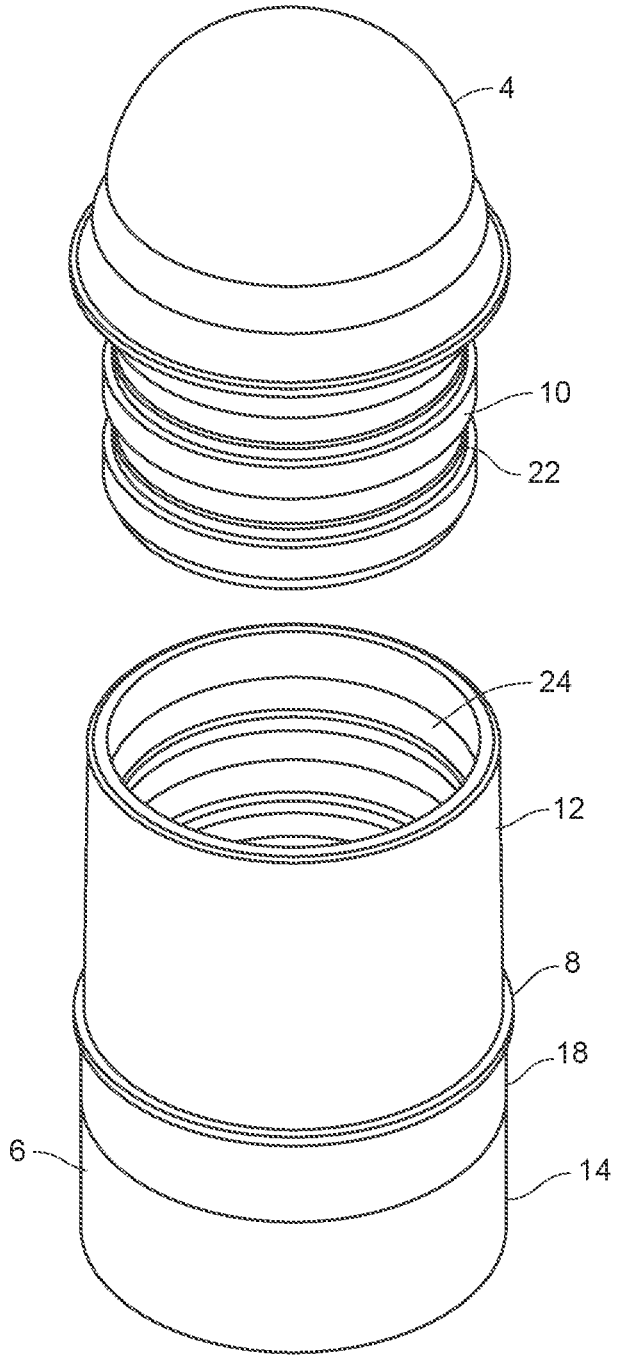
FIG. 9 is an exploded perspective view of the non-lethal projectile depicted in FIG. 5.
Figure 10:
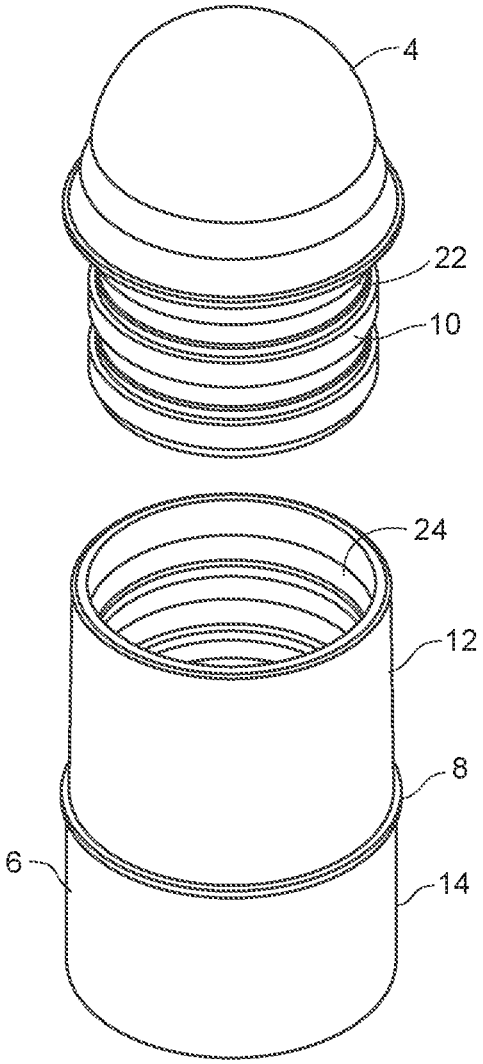
FIG. 10 is an exploded perspective view of a non-lethal projectile having a driving band according to an embodiment of the present invention.
Figure 11:
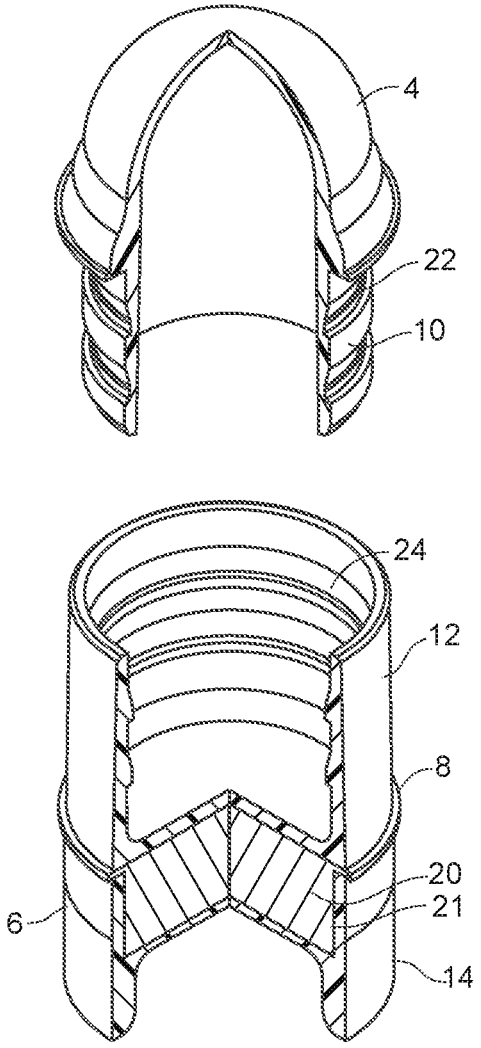
FIG. 11 is an exploded, cross-sectional perspective view of the non-lethal projectile depicted in FIG. 10.
Figure 14:
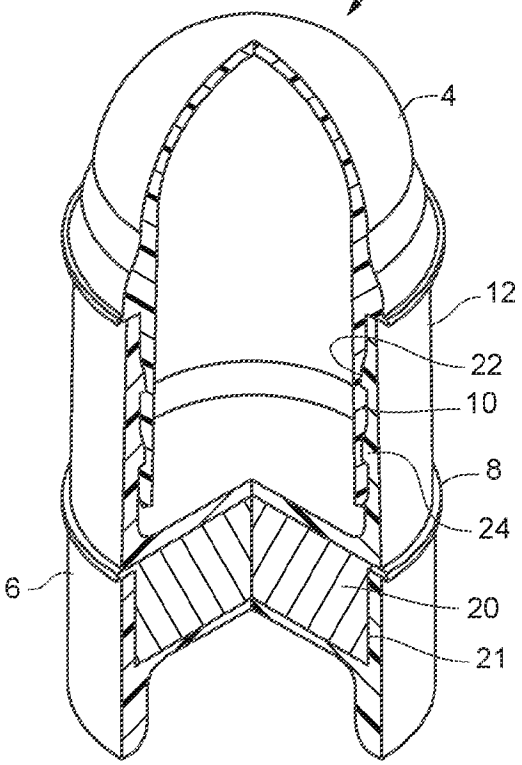
FIG. 14 is a partial cross-sectional perspective view of the non-lethal projectile depicted in FIG. 10.
Figure 13:
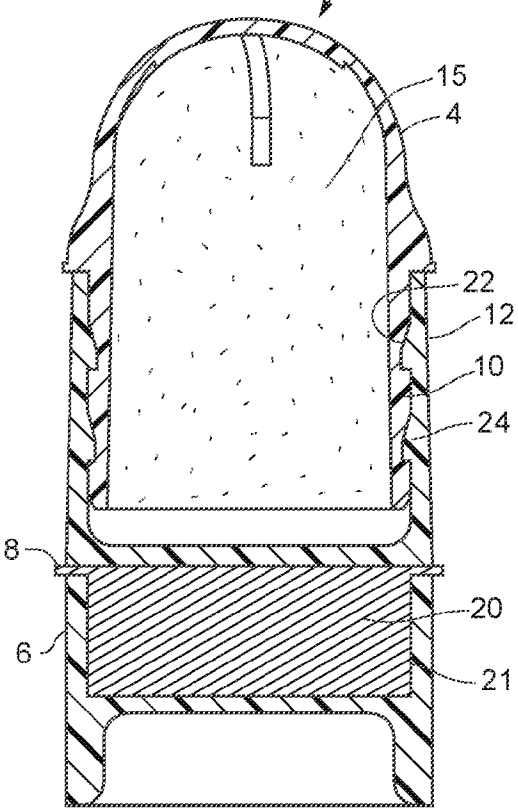
FIG. 13 is a cross-sectional side view of the non-lethal projectile depicted in FIG. 10.
Figure 12:
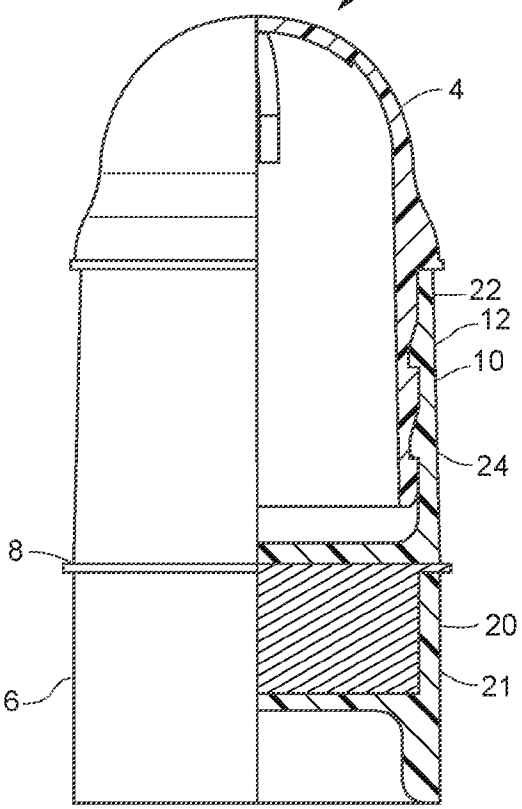
FIG. 12 is a partial cross-sectional side view of the non-lethal projectile depicted in FIG. 10.
Figure 15:
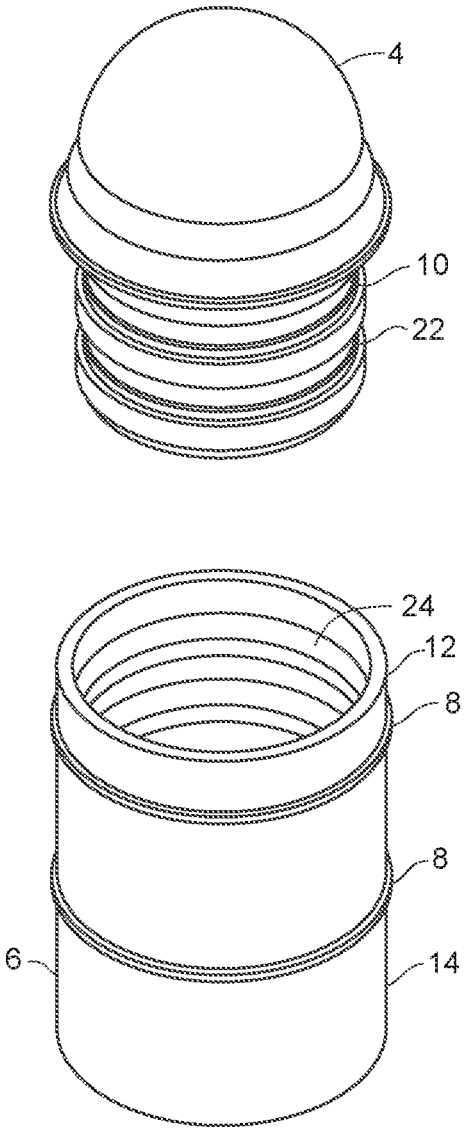
FIG. 15 is an exploded perspective view of a non-lethal projectile having a driving band according to an embodiment of the present invention.
Figure 16:
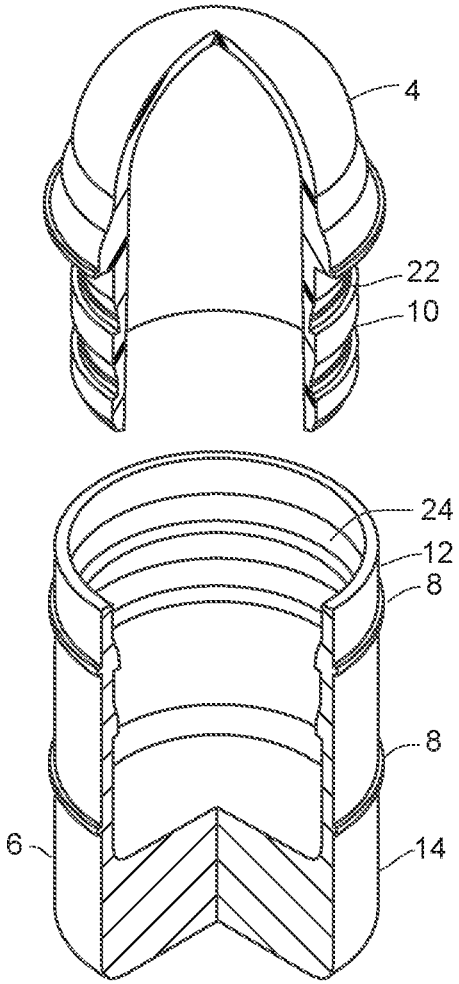
FIG. 16 is an exploded, cross-sectional perspective view of the non-lethal projectile depicted in FIG. 15.
Figure 19:
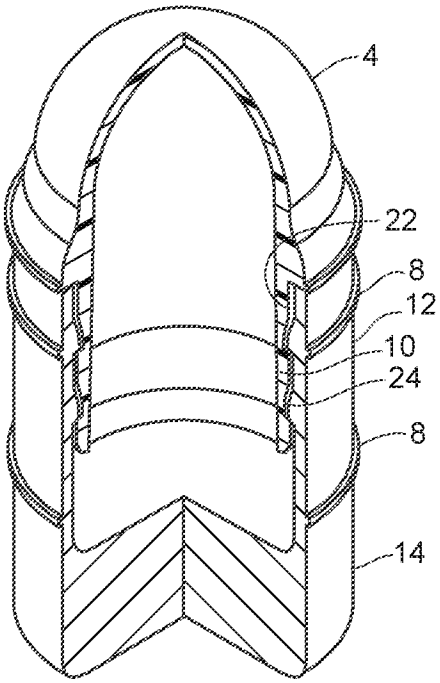
FIG. 19 is a partial cross-sectional perspective view of the non-lethal projectile depicted in FIG. 15.
Figure 18:
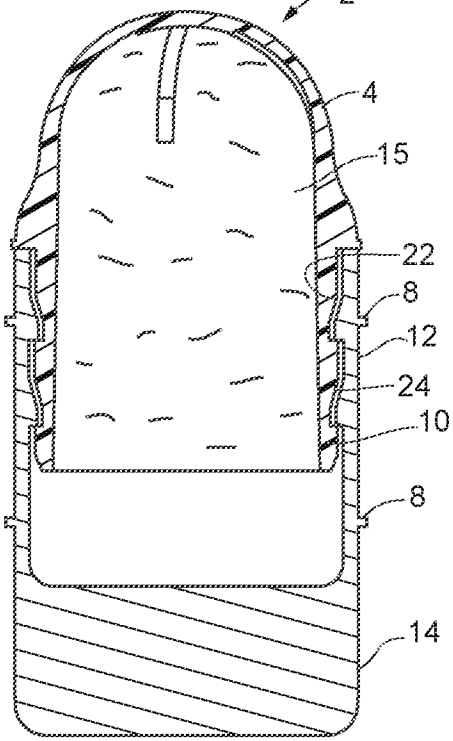
FIG. 18 is a cross-sectional side view of the non-lethal projectile depicted in FIG. 15.
Figure 17:
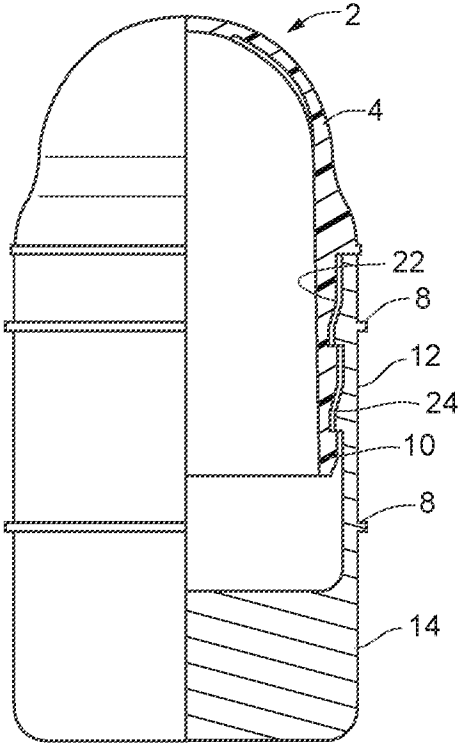
FIG. 17 is a partial cross-sectional side view of the non-lethal projectile depicted in FIG. 15.
Figure 22:
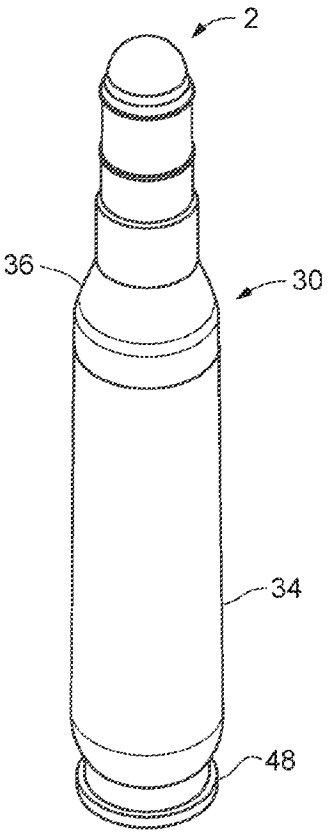
FIG. 22 is a perspective view of the non-lethal cartridge depicted in FIG. 20.
Figure 21:
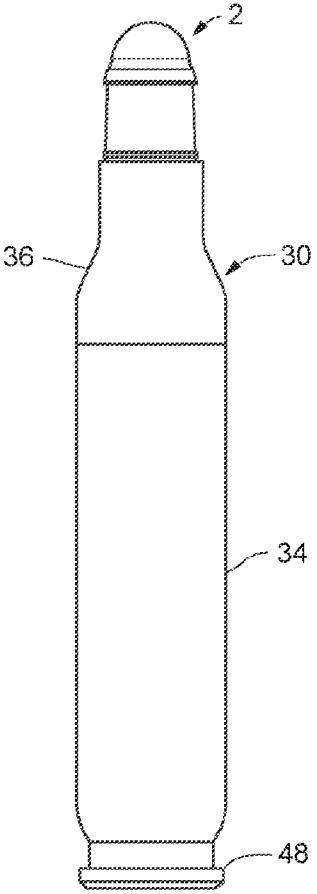
FIG. 21 is a side view of the non-lethal cartridge depicted in FIG. 20.
Figure 20:
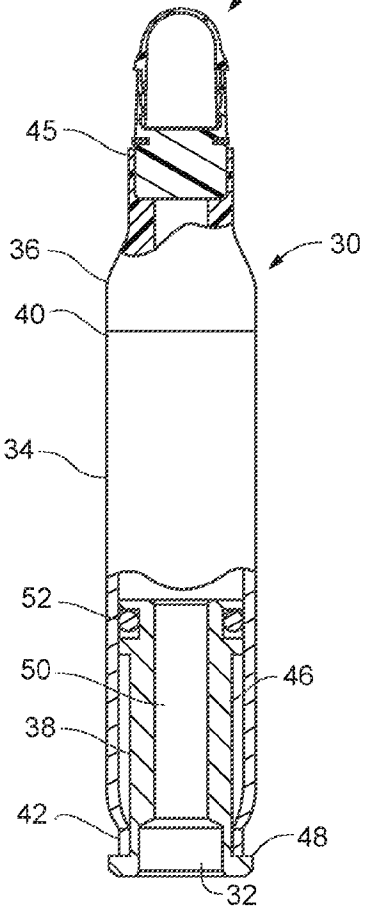
FIG. 20 is a partial cross-sectional side view of a non-lethal cartridge for firing a non-lethal projectile having a driving band according to an embodiment of the present invention.
Figure 23:
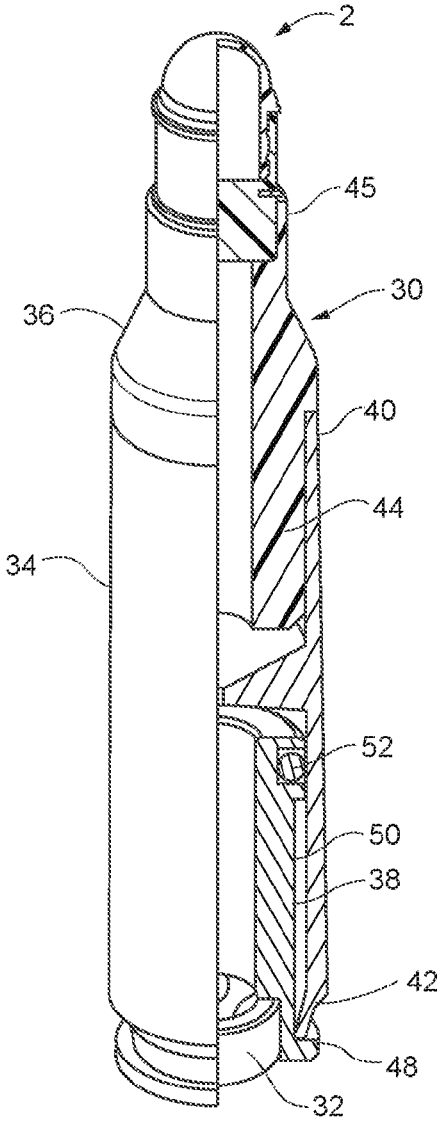
FIG. 23 is a partial cross-sectional perspective view of the non-lethal cartridge depicted in FIG. 20 prior to deployment of a telescoping portion of the cartridge.
Figure 24:
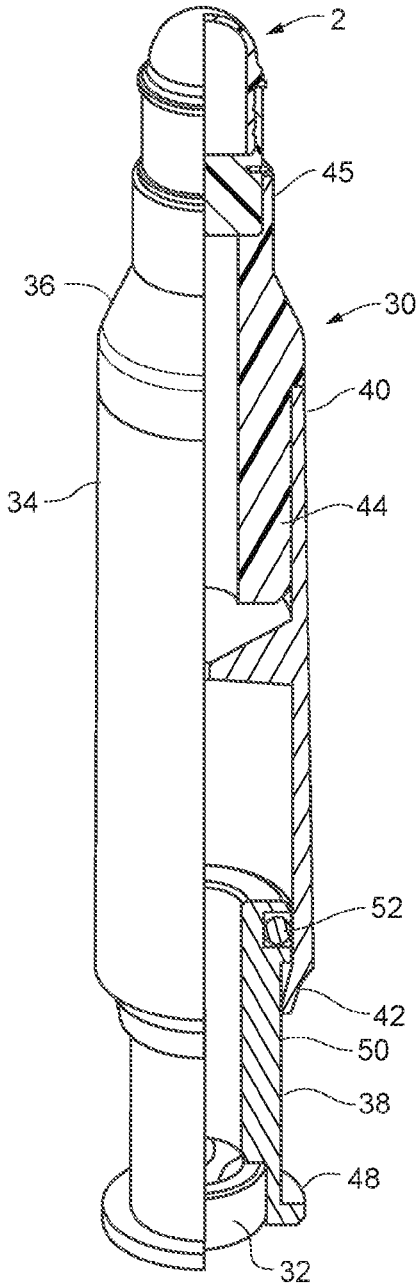
FIG. 24 is a partial cross-sectional perspective view of the non-lethal cartridge depicted in FIG. 20 after deployment of a telescoping portion of the cartridge.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

As shown in FIGS. 1 to 4, a non-lethal projectile 2, according to an embodiment of the present invention, presents an primarily polymer body 3 configured as a sealed enclosure and comprising a forward portion configured as a frangible cap 4, a rearward portion or projectile base 6 and at least one driving band 8, the components meeting at a juncture 7. The projectile is suitably bullet shaped and sealingly encloses marking media 15 therein. The frangible cap 4 can further comprise an engagement portion 10 for affixing the cap 4 to the projectile base 6. The projectile base 6 has a cooperating engagement portion 11 can further comprise a cup portion 12 and a base portion 14. The engagement portion 10 is receivable within the cup portion 12 to affix the cap 4 to the projectile base 6 and to define a cavity 13 for receiving a payload. In one aspect, in addition to marking media 7 that is deposited on the target upon impact to identify the location of the impact, other payloads may be utilized a solid material that provides additional mass to the projectile for accurate flight without marking the target. In the configuration illustrated, the frangible cap 4 can comprise a transparent material allowing for visual identification of the color of the marking media. According to an embodiment of the present invention, the projectile 2 can also comprise a solid bullet shaped base comprising a single polymer material and being light weight, such as less than 5 grains for a 5.56 mm diameter projectile, and having one or more metal driving bands extending therefrom. The projectile has an axis A. The marking media may be a liquid, paste, gel, powder or other material.

Figure 28:
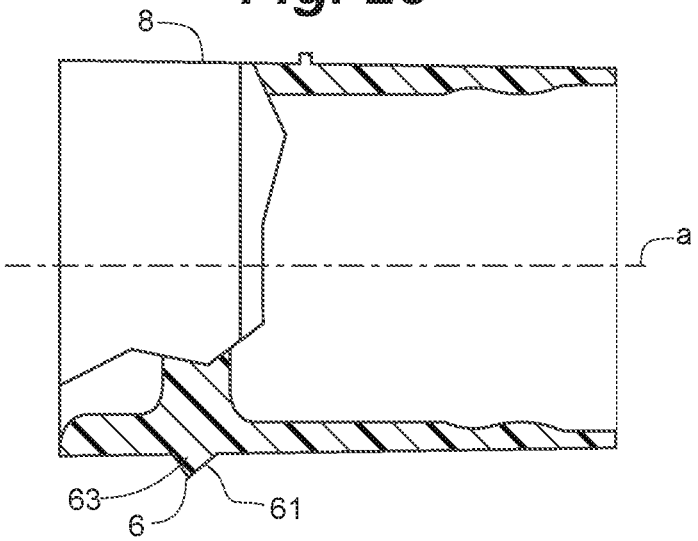
FIG. 28 is a partial cross-sectional side view of a projectile base according to an embodiment of the present invention.
Figure 29:
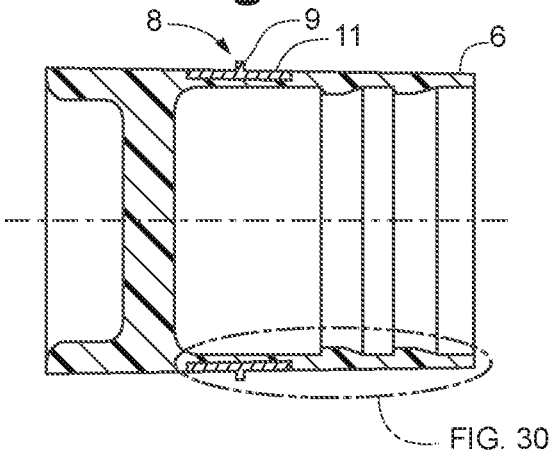
FIG. 29 is a cross-sectional side view of the projectile base depicted in FIG. 28.
Figure 30:
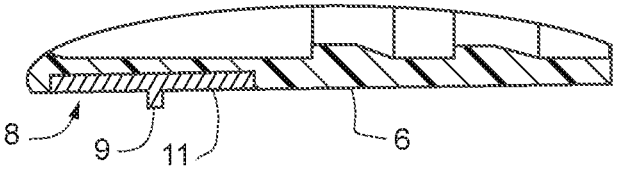
FIG. 30 is a cross-sectional partial view of the projectile base depicted in FIG. 29 showing a driving band according to an embodiment of the present invention.
Figure 46:
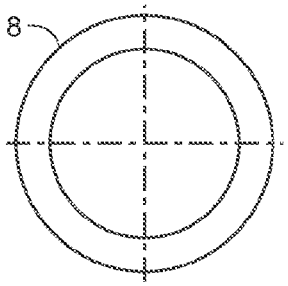
FIG. 46 is a top view of a metal driving band in isolation.
Figure 47:
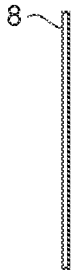
FIG. 47 is a side view of the metal driving band of FIG. 46.

The driving band 8 extends radially around the exterior of the projectile base 6. In one embodiment, the driving band 8 is positioned around the base portion 14 of the projectile base 6. A projecting portion 9 of the driving band 8 protrudes from outward from the projectile base 6 to engage the rifling of a barrel when the projectile 2 is fired. An embedded portion 11 of the driving band 6 is inset into the projectile base 6. In one aspect of the present invention, the driving band 6 comprises a cantilevered ring shape in which the driving band 6 is perpendicular to the axis of the projectile base 6 and the projecting portion 9 cantilevers radially outward from the projectile base 6 as shown in FIGS. 46-47. In one aspect, the embedded portion 11 can have the same thickness as the projecting portion 9 as shown in FIGS. 1-2 and 34-36. In another aspect, the embedded portion 11 can have a greater thickness than the projecting portion 9 as shown in FIGS. 5-6 and 28-32. In this configuration, the embedded portion 11 and projecting portion 9 are arranged in a T-shaped configuration wherein the projecting portion 9 extends from approximately the center of the embedded portion 11 as shown in FIGS. 28-30. Alternatively, the embedded portion 11 and projecting portion 9 is arranged in an L-shaped configuration as shown in FIGS. 5-6 and 25-27. The projectile base 6 can further comprise a groove 16 for receiving the embedded portion 11 of the driving band 8.

Figure 39:
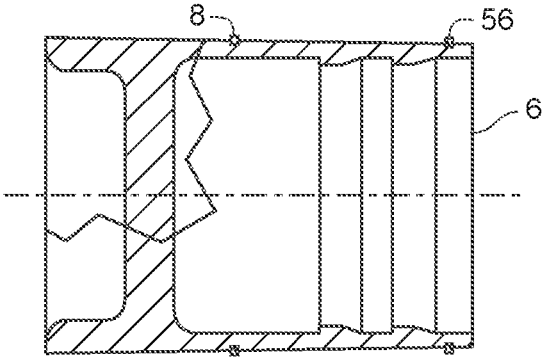
FIG. 39 is a partial cross-sectional side view of a projectile base according to an embodiment of the present invention.
Figure 40:
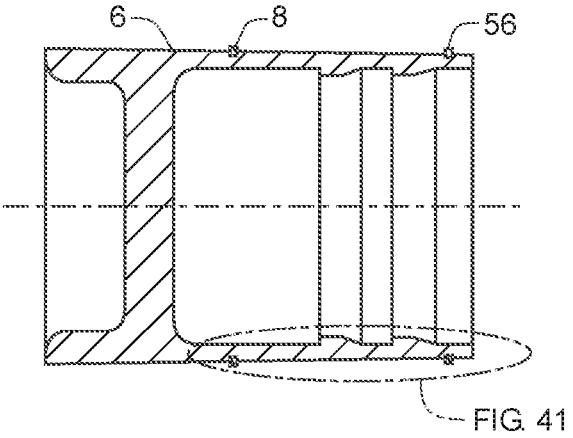
FIG. 40 is a cross-sectional side view of the projectile base depicted in FIG. 39.
Figure 41:
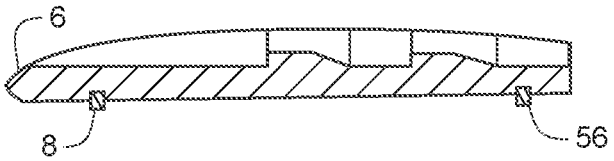
FIG. 41 is a cross-sectional partial view of the projectile base depicted in FIG. 40 showing a two driving band configuration according to an embodiment of the present invention.

As shown in FIGS. 39-41, the projectile 2 can further comprise a second driving band 56 cooperating with the first driving band 8 to minimize yaw effects and polymer portions of the projectile from engaging the rifling of the barrel. In one aspect, the driving band 6 can extend in a helical arrangement around the projectile base 6. In this configuration, the helically arranged driving bands 6 can engage the air after firing to further spin stabilize the projectile 2.

According to an embodiment, the projectile 2 can be sized to replicate the dimensions of the bullet for 5.56×45 mm NATO ("5.56 NATO") or .223 REMINGTON ammunition. The conventional bullets of 5.56 NATO cartridges and .223 REMINGTON have a diameter of 0.224 in (5.70 mm). According to an embodiment, the driving band 8 can have an outer diameter of 0.223 in (5.66 mm) and a thickness of 0.005 (0.127 mm) in such that the projecting portion 9 of the driving band 8 protrudes from the projectile base 6 for engaging the rifling of barrels sized for 5.56 NATO or .223 REMINGTON ammunition. In one aspect, the projectile base 6 can be dimensioned such that such that the outer diameter of the projectile base 6 is such that the projectile base 6 can travel through the barrel without engaging the rifling. According to an embodiment, the inner diameter of the driving band 8 can comprise 0.154 in (3.912 mm) such that the embedded portion 11 of the driving band 8 is seated within the projectile base 6.

Although the projectile 2 is sized to approximate the conventional equivalent, the weight of the projectile 2 is less than the conventional equivalent. A conventional bullet weight for a 5.56 NATO bullet can be about 4 grams. In one embodiment, the total weight of the projectile 2 for simulating 5.56 NATO bullet and containing a payload media can weight about 0.24 grams wherein the driving band 8 comprises about 15% of the total weight of the projectile 2; in other embodiments, from 10 to 20%. In aspect, the total weight of the projectile 2 with a payload media can be about 5 to 10% of the weight of the equivalent projectile. In another aspect, the total "empty" weight of the projectile 2 without a payload media can be about 1 to 5% of the weight of an equivalent conventional projectile 2. In embodiments the total weight of the projectile is less than 5 grains. In embodiments the total weight of the projectile is less than 6 grains. In embodiments the total weight of the projectile is less than 7 grains. In embodiments the total weight of the projectile is less than 10 grains. The inventors have discovered that projectiles of less than 4.25 grains may be fired from telescoping 5.56 mm practice cartridges as illustrated in FIGS. 20-24, using only the propellant in the primer, at velocities up to about 520 fps using metal driving bands. With such velocities accuracy is extremely good and the kinetic energy is under 62 ft-lb/inch$^2$. This arrangement provides better accuracy and less energy than conventional 5.56 mm practice ammunition with marking projectiles. With less energy, the ammunition is safer.

The projectile base 6 can comprise principally a thermoplastic polymer. Other embodiments can comprise ceramic material, compressed fibrous pulp, lightweight metal or other lightweight material that can be formed to define a projectile base 6. The driving band 8 can comprise a gilding metal, a more rigid polymer than that used to form the projectile base 6, a metal impregnated polymer or other composite material. According to an embodiment, the driving band can comprise 110 Copper (99.9% copper, 0.04% oxygen). Other materials include brass The material of the driving band 8 provides more advantageous engagement characteristics than the base material of the projectile base 6. For example, better coefficient of friction with respect to firearm barrels, less sloughing of material, easier deformation to conform to the rifling of the barrel. The frangible cap 4 can comprise a frangible material, such as polystyrene, adapted to fracture upon impact with the target to release the payload within the cavity and/or reduce force with which the projectile 2 impacts the target.

In an embodiment of the present invention, the driving band 8 can serve to weight the exterior of the projectile base 6 to further facilitate spin stabilization of the projectile 2. The protruding portion 9 and/or the embedded portion 11 of the driving band 8 can be varied in size to increase or decrease the weight of the driving band 8 relative to the rest of the projectile 2 as shown in FIGS. 5-14. In one aspect, the weight of the driving band 8 can be about 10 to 20% of the total weight of the projectile 2.

As shown in FIGS. 5 to 9, according to an embodiment, each driving band 8 can further comprise a cylindrical portion 18 that is flush with the exterior of the projectile base 6. The flattened portion 18 provides additional weight around the exterior of the projectile base 6 to facilitate the spin of the projectile 2 during flight and improve the ballistic characteristics of the projectile 2. In this configuration, the groove 16 can shaped to increase or decrease the amount of material in the flattened portion 18 to change of center of mass of the projectile 2.

As shown in FIGS. 10 to 14, according to an embodiment, each driving band 8 can further comprise a weighting portion 20 positioned within a cavity 20 defined within the base portion 14. In this configuration, the material used for the driving band 8 can be denser than the material used for the projectile base 6 such that the weighting portion 20 moves the center of mass of the projectile 2 toward the rear of the projectile base 6 for improved ballistic characteristics.

As shown in FIGS. 15 to 19, according to an embodiment, the driving band 8 can be integral to the projectile base 6. In this configuration, the projectile base 6 can comprise a lightweight metal capable of engaging the rifling with minimal friction without increasing the weight of the projectile 2 such that the momentum of the projectile 2 can cause injury or death upon impact. The lightweight metal can include, but is not limited to aluminum, copper, steel and various alloys thereof.

As shown in FIGS. 46 to 47, according to an embodiment of the present invention, a projectile 60 comprises a cup portion 62, a connector portion 64 and a base portion 66. The connector portion 64 defines a first socket 68 for receiving the cup portion 62 and a second socket opposite the first socket 70 for receiving base portion 66. The connector portion 64 further comprises a protruding portion 72 for engaging the rifling of the barrel. In this configuration, the connector portion 64 can comprise a lightweight gilding metal such as the driving band 8 while the cup and base portions 62, 66 comprise lightweight polymers.

As shown in FIGS. 1 to 19, the frangible cap 2 can define at least one notch 22 for engaging the projectile base 6. In this configuration, the cup portion 12 can further comprise a protrusion 24 corresponding to each notch 22 to retain the engagement portion 10 of the cap 2 within the cup portion 12.

Figure 27:
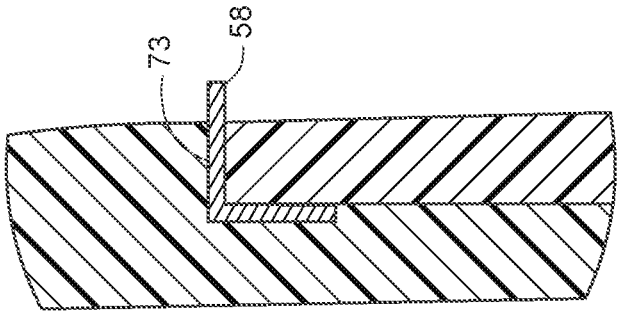
FIG. 27 is a cross-sectional partial view of the projectile base depicted in FIG. 26 showing a driving band according to an embodiment of the present invention.
Figure 26:
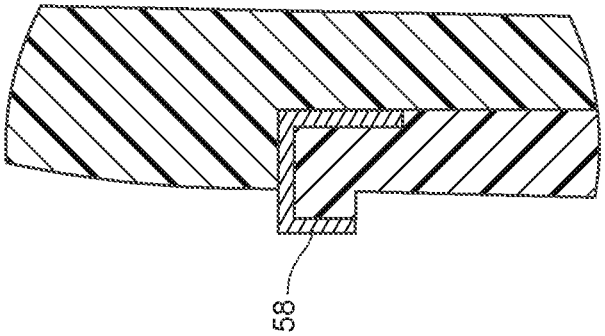
FIG. 26 is a cross-sectional side view of the projectile base depicted in FIG. 25.
Figure 25:
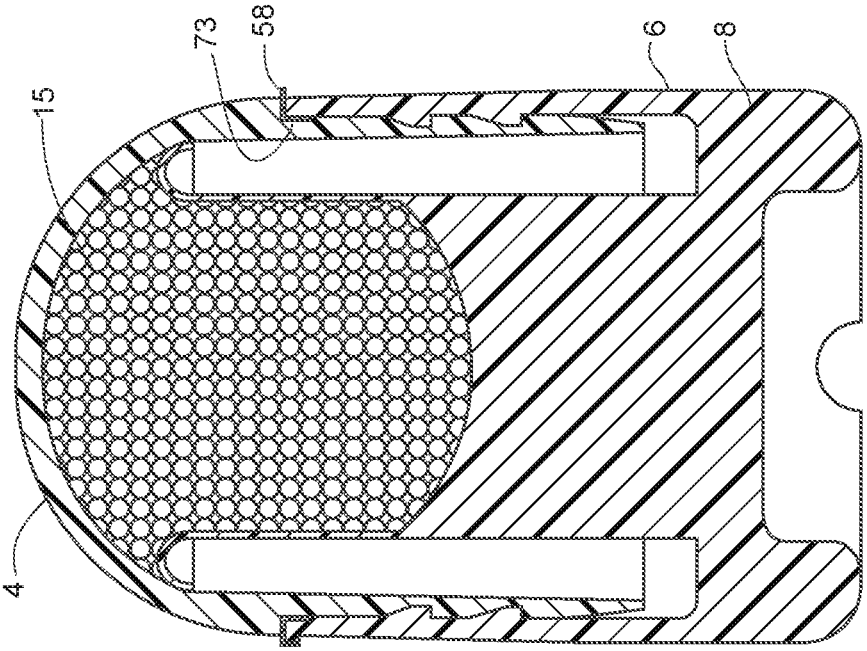
FIG. 25 is a partial cross-sectional side view of a projectile base according to an embodiment of the present invention.

As shown in FIGS. 25-27, the projectile can further comprise a second driving band 58 at the frangible cap 2 also adapted to engage rifling of the barrel. The second driving band 58 cooperates with the driving band 8 positioned on the projectile base 6 to facilitate travel of the projectile 2 through the barrel minimal or no portions of the projectile base 6 or frangible cap 2 being directly engaged by the rifling of the barrel. As shown in FIGS. 26 and 27, the driving band may be placed at the juncture 73 of the cap 2 and base 6. In one aspect, the second driving band 58 can be embedded into the frangible cap similar to the first driving band.

As shown in FIGS. 20 to 24, in an embodiment of the present invention, the non-lethal projectile 2 can be fired from a reduced energy cartridge 30 adapted to propel the projectile 2 with gases generated only by a primer 32 from a conventional firearm. The cartridge 30 further comprises a cartridge casing 34, a neck portion 36 and a telescoping insert 38 adapted to telescope upon firing to trigger the cycling mechanism of the firearm. The cartridge casing 34 defines an internal cavity having a first opening 40 and a second opening 42. The neck portion 36 can comprise an insert portion 44 receivable within the first opening 40 affix the neck portion 36 to the cartridge casing 34. The neck portion 36 can also comprise a seating portion 45 for receiving the projectile 2. According to an embodiment, the neck portion 36 can be shaped to fit within the chamber of a firearm sized for 5.56 NATO cartridges. According to an embodiment, the neck portion 36 can comprise a glass filed nylon that is resistant to the temperatures associated with the hot gases.

The telescoping insert 38 comprises a telescoping portion 46 and a rim 48. The telescoping portion 46 is receivable within the second opening 42 such that the rim 48 is positioned against the second opening 42. The telescoping insert 38 defines a channel 50 for receiving the primer 32 and adapted to channel gases generated by igniting the primer 32 toward the projectile 2. According to an embodiment, the telescoping portion 46 can further comprise a gasket 52 engagable to the casing 34 to prevent gases from escaping between the telescoping portion 46 and the casing 34.

According to an embodiment, the cartridge casing 34 can define a flash hole 54 between the telescoping portion 46 and the projectile 2. During firing, the flash hole 54 compresses the gases generated by the ignited primer 32 into a gas jet, which propels the projectile 2 down the barrel of the firearm and to the target. Correspondingly, the projectile base 6 can define an indent 56 for capturing the gas jet to more efficiently fire the projectile 2 down the barrel.

Figure 42:
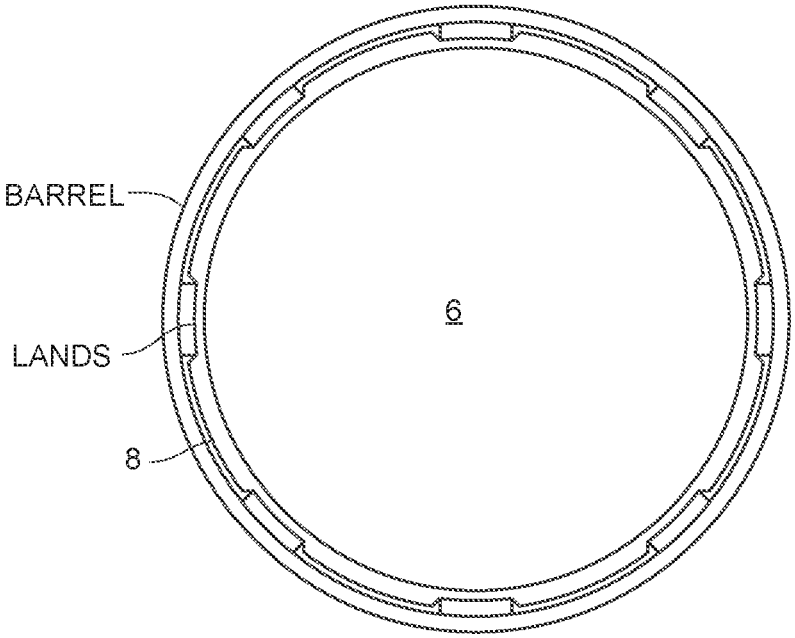
FIG. 42 is a front view of a projectile according to an embodiment of the present invention traveling through a barrel in which the lands of the rifling etch grooves in the driving band.
Figure 43:
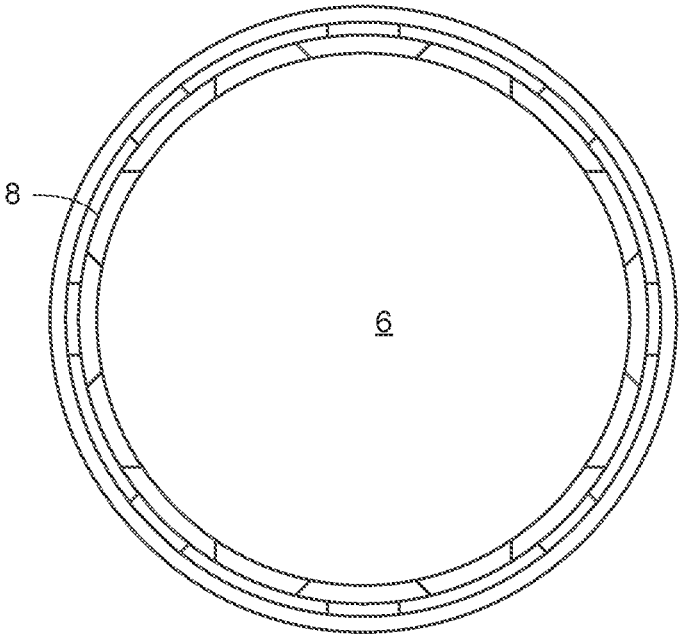
FIG. 43 is a front view of a projectile according to an embodiment of the present invention traveling through a barrel in which the lands of the rifling fold over the driving band.

During firing, the projectile 2 travels through the rifled barrel of the firearm such that the driving band 8 is engraved by the rifling of the barrel. The rifling imparts a spin to the projectile 2 such that the projectile 2 is spin stabilized once the projectile 2 leaves the barrel. In one aspect, the driving band 8 comprises a material of sufficient hardness such that projection portion 9 of the driving band 8 to be etched in the same way as a conventional bullet as shown in FIG. 42. After the initial etching, the projectile 2 travels through the barrel with minimal friction. In another aspect, the driving band 8 can comprise a more flexible material allowing the projecting portion 9 to flex when engaged by the rifling such that the projecting portion 9 "folds over" when engaged by the rifling as shown in FIG. 43. According to an embodiment, the driving band 8 can unfurl and separate from the projectile 2 after the projectile 2 exits the muzzle of the barrel or travel with the projectile 2 to the target.

FIG. 28 illustrates a driving band having an outwardly an forward exposed surface 61 configured as a conical surface, that is angled or tapered toward the front of the bullet. Also the driving band has a support portion 63 configured as a unitary circular rib on the base.

Figure 31:
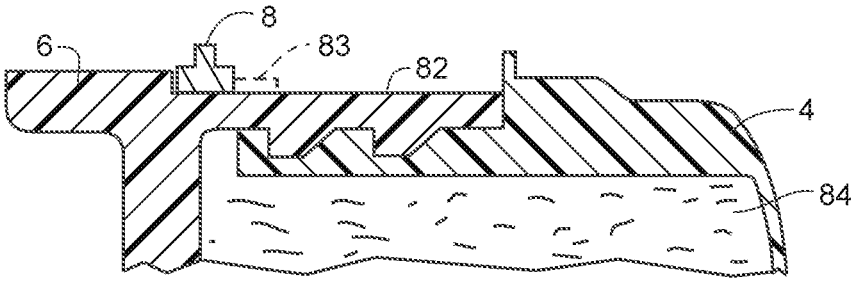
FIG. 31 is a partial cross-sectional side view of a projectile according to an embodiment of the present invention.
Figure 32:
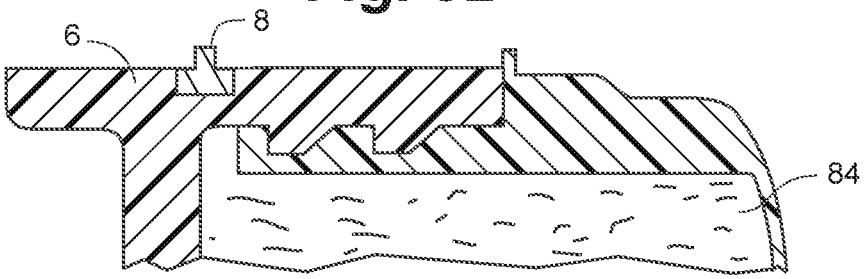
FIG. 32 is a cross-sectional side view of a projectile according to an embodiment of the present invention.
Figure 33:
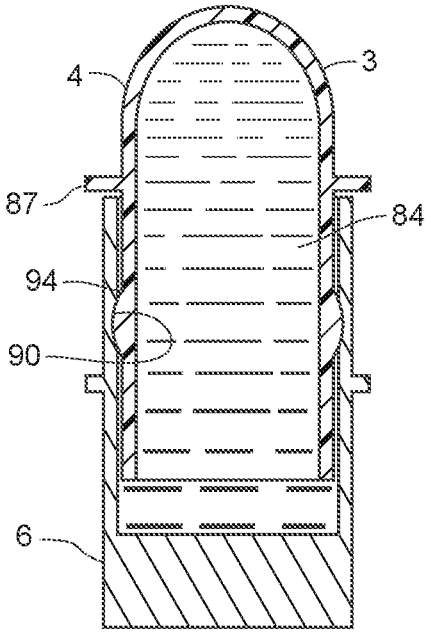
FIG. 33 is a cross-sectional partial view of a projectile according to an embodiment of the present invention with a metal base and a polymer cap.
Figure 34:
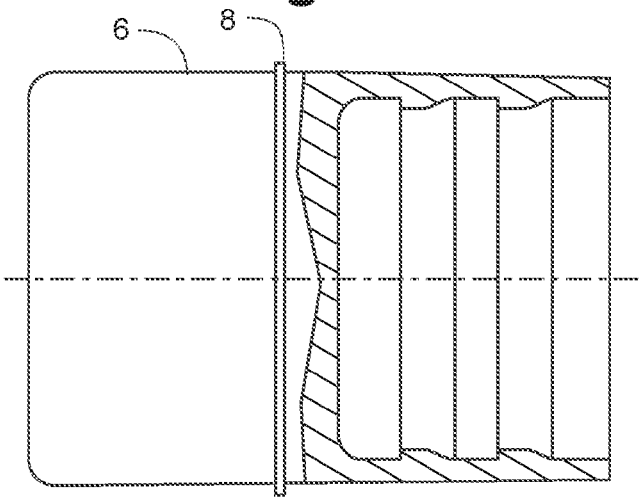
FIG. 34 is a partial cross-sectional side view of a projectile base according to an embodiment of the present invention.
Figure 35:
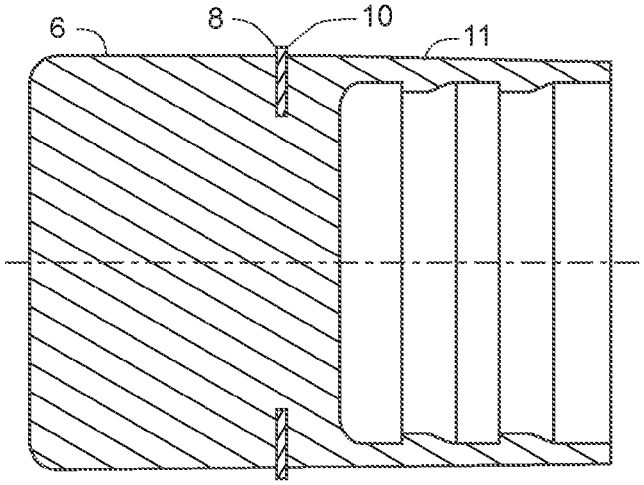
FIG. 35 is a cross-sectional side view of the projectile base depicted in FIG. 34.
Figure 36:
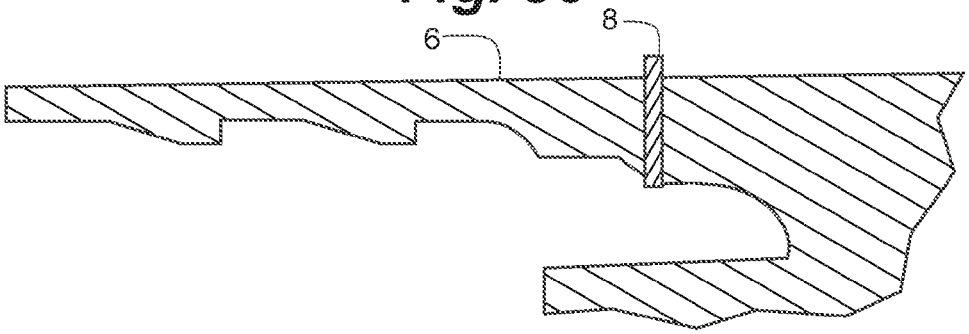
FIG. 36 is a cross-sectional partial view of the projectile base depicted in FIG. 35 showing a driving band according to an embodiment of the present invention.

Referring to FIGS. 29-33, additional embodiments with T-shaped (in the cross section) driving bands are illustrated. FIGS. 29 and 30 illustrate a configuration where the base may be overmolded on the band, that is with the band placed in the mold first and the polymer injected second. FIG. 31 illustrates a driving band 8 assembled by sliding the band on the base 6 over a reduced diameter portion 82. Features such as bumps or wedge shaped portions 83 extending from the surface of the reduced diameter portion may be utilized to secure the band in place. The band will typically be applied to the base, the marker material 84 added to the cap 4 or base, and then the cap and base will be assembled together. The projectiles then may be placed in the casings. Alternatively the base may already be in the casing prior to assembly of the cap and addition of marking material. The band in this embodiment has a T-shaped cross section and may be formed of aluminum or copper or brass or other metals. In FIG. 32, a T-shaped driving band is embedded in the base such as by overmolding the base polymer thereon. A leading driving band 87 may be a conventional polymer formed of the material of the cap, such as polystyrene, or may be metal or metalized as described herein. FIG. 33 illustrates a projectile configured as a bullet shaped sealed enclosure 3 with an aluminum base 6 and a polymer cap 4. The driving band 8 is aluminum and is unitary and integral with the base. The cap may have a second driving band 87 that is a polymer or metal or metalized as disclosed herein. The aluminum base 6 may have a recess 90 in an inwardly facing wall surface 93 to cooperate with an outwardly extending ring 94 in the skirt of the cap.

Figure 37:
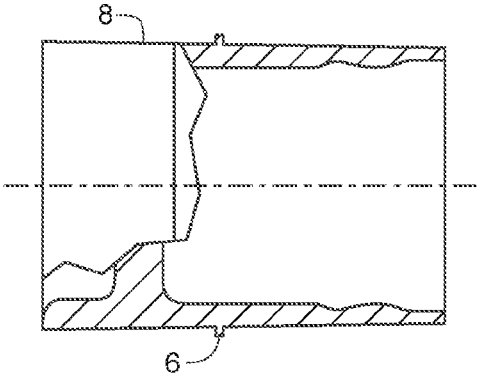
FIG. 37 is a partial cross-sectional side view of a projectile base according to an embodiment of the present invention.
Figure 38:
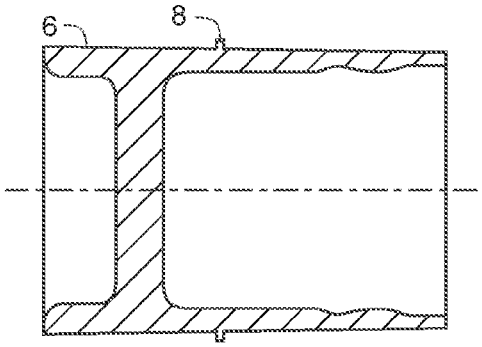
FIG. 38*a* is a cross-sectional detail of the driving band on the projectile base depicted in FIG. 37.
FIG. 38*b* is a cross-sectional detail a portion of the driving band on the projectile base depicted in FIG. 37 that has engaged a land of barrel rifling.
FIG. 38*c* is a cross-sectional detail a portion of the driving band on the projectile base depicted in FIG. 38*b* that has engaged a groove of barrel rifling.
Figure 38A:
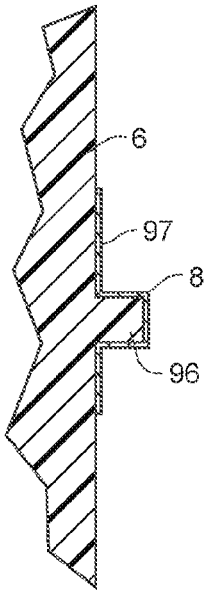
Figure 38B:
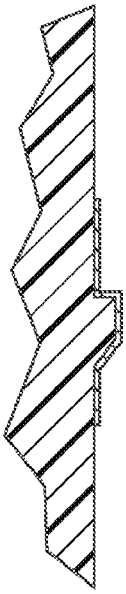
Figure 38C:
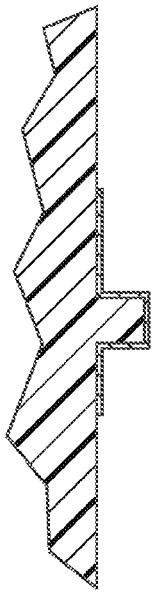

FIGS. 37-38*c* illustrate embodiments of the invention where the driving band 8 or a portion 96 of the driving band is comprised of a polymer, generally the polymer forming the base 6, and further by a metal portion 97 or metalized portion. Portions of the driving band that engage lands of the rifling may be deformed, primarily by the polymer portion 96 deforming while still retaining the exterior layer of metal or metalized material. Such metal may be a foil adhered to the polymer by adhesives or by partially melting the polymer. Such metallization may be by depositing metal on the band.

Figure 44:
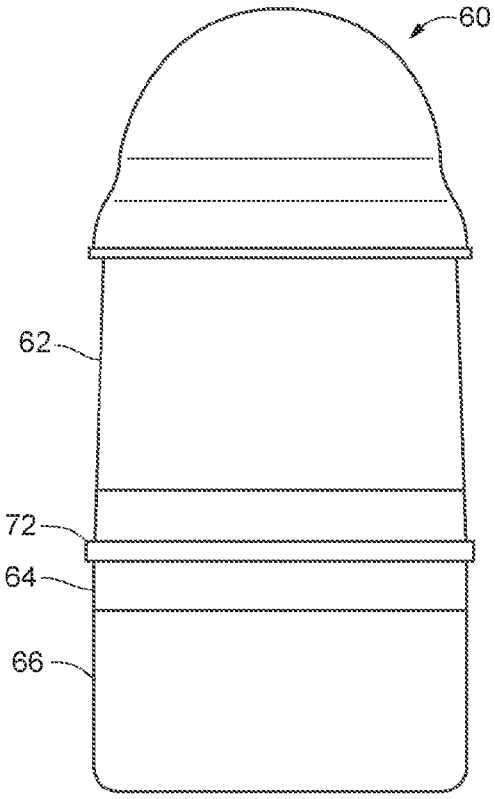
FIG. 44 is a side view of a projectile according to an embodiment of the present invention.
Figure 45:
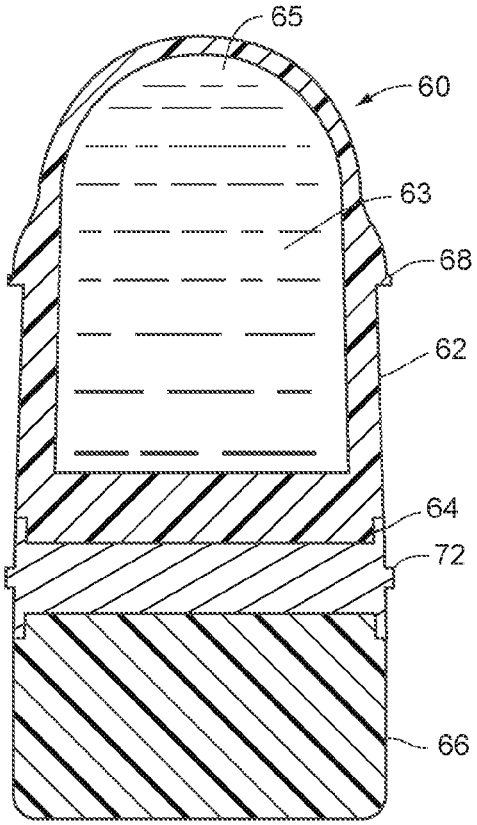
FIG. 45 is a cross-sectional side view of the projectile depicted in FIG. 44.

FIGS. 44 and 45 illustrate a projectile 60 in an embodiment with an axial section 64 formed of metal with a polymer base 66 therebelow and a cap portion 62 with a closed cavity 63 therein, with marking material 65 therein. The band has surface extensions 64 providing capture regions for the base and cap both of which can be overmolded on the band. The band can be metal or metalized polymer or other materials that has a coefficient of friction less than the polymer or polymers of the base and cap. The cap may have a further driving band 68 which also may be metalized or metal or may be the material of the cap.

A method of making a non-lethal projectile with at least one driving band, according to an embodiment of the present invention, can comprise separately stamping or forming the driving band and the polymer base. The driving band can then be fitted over the polymer base to affix the driving band to the polymer base. Alternatively, the driving band can be placed in a mold and the projectile base or the base portion of the projectile base can be molded over the driving band. According to another embodiment, a polymer driving band can be over-molded onto a pre-molded polymer base. Powdered metal can be sintered onto a driving band on a polymer base.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A lightweight projectile in combination with a telescoping casing, the projectile adapted to be fired through a rifled barrel sized for 5.56 NATO ammunition, comprising:

a bullet shaped projectile sized to be fired in barrel for firing traditional 5.56 NATO ammunition, the projectile having a body with a sealed interior space therein with marking media sealed in the space;

the projectile body comprising a frangible polymer cap for releasing the marking media on impact; and at least one metal driving band extending circumferentially around the projectile body and having an embedded portion inset within the projectile body and a projecting portion extending radially outward, wherein the projecting portion is adapted to engage the rifling of the barrel to impart spin stabilization to the projectile and to reduce friction between the projectile and the rifled barrel, wherein the driving band comprises metal and wherein the projectile weighs less than 10 grains.

2. The lightweight projectile and casing of claim 1, wherein the projectile weighs less than 7 grains.

3. The lightweight projectile and casing of claim 2, wherein the driving band comprises a ring shape extending radially in a plane perpendicular to an axis of the projectile, and wherein the embedded portion has the same thickness as the projecting portion.

4. The lightweight projectile and casing of claim 1 wherein the embedded portion is wider than the protruding portion.

5. The lightweight projectile and casing of claim 4, wherein the protruding portion and the embedded portion is arranged in one of a T-shape and a L-shape when viewed in cross section.

6. The lightweight projectile and casing of claim 1, wherein the projecting portion comprises a flexible material such that a portion of the projecting portion folds over upon engagement by the rifling of the barrel.

7. The lightweight projectile of claim 1, wherein the frangible polymer cap cooperating engages a polymer projectile base.

8. The lightweight projectile base of claim 7, wherein the driving band is positioned at a juncture between the cap and base.

9. The lightweight projectile of claim 1, wherein the driving band is formed of one of copper and brass.

10. The lightweight projectile of claim 1, wherein the frangible cap has a second driving band to prevent engagement of the polymer base by the rifling as the projectile travels down the barrel.

11. The lightweight projectile of claim 1, wherein the driving band is adjacent to an outwardly protruding polymer rib extending from the projectile body.

12. A lightweight projectile in combination with a telescoping casing, the projectile adapted to be fired through a rifled barrel sized for 5.56 NATO ammunition, comprising:

a bullet shaped projectile sized to be fired in barrel for firing traditional 5.56 NATO ammunition, the projectile having a body with a sealed interior space therein with marking media sealed in the space;

the projectile body comprising a frangible polymer cap for releasing the marking media on impact; and at least one metal driving band extending circumferentially around the projectile body and having an embedded portion inset within the projectile body and a projecting portion extending radially outward, wherein the projecting portion is adapted to engage the rifling of the barrel to impart spin stabilization to the projectile and to reduce friction between the projectile and the rifled barrel, wherein the driving band comprises metal and wherein the projectile has a kinetic energy under 62 ft-lb/inch' when fired through the rifled barrel, wherein the projectile weighs less than 7 grains.

* * * * *